US009659510B2

(12) United States Patent
Myoung

(10) Patent No.: US 9,659,510 B2
(45) Date of Patent: May 23, 2017

(54) BAG CLIP WITH DATE WHEEL

(71) Applicant: Progressive International Corporation, Kent, WA (US)

(72) Inventor: Sul Gi Myoung, Federal Way, WA (US)

(73) Assignee: Progressive International Corporation, Kent, WA (US)

( * ) Notice: Subject to any disclaimer, the term of this patent is extended or adjusted under 35 U.S.C. 154(b) by 177 days.

(21) Appl. No.: 14/609,906

(22) Filed: Jan. 30, 2015

(65) Prior Publication Data

US 2015/0221245 A1 Aug. 6, 2015

Related U.S. Application Data

(60) Provisional application No. 61/935,243, filed on Feb. 3, 2014.

(51) Int. Cl.

| | |
|---|---|
| ***B65D 33/16*** | (2006.01) |
| ***G09F 11/23*** | (2006.01) |
| ***G09D 3/10*** | (2006.01) |
| ***G09D 3/04*** | (2006.01) |
| ***G09D 3/06*** | (2006.01) |
| ***G09D 3/08*** | (2006.01) |

(52) U.S. Cl.

CPC ..... *G09F 11/23* (2013.01); *B65D 33/1675* (2013.01); *G09D 3/04* (2013.01); *G09D 3/06* (2013.01); *G09D 3/08* (2013.01); *G09D 3/10* (2013.01)

(58) Field of Classification Search

CPC ..... G09F 11/00; G09F 11/02; G09F 11/04; G09F 11/06; G09F 11/23; B65D 2203/00; B65D 33/16; B65D 33/1675

USPC ..... 116/307–320; 40/647, 648, 658, 659, 40/666

See application file for complete search history.

(56) References Cited

U.S. PATENT DOCUMENTS 576,834 A * 2/1897 Chapman ..... A61J 7/04 116/308
3,347,204 A * 10/1967 Beall ..... B42F 17/34 116/312
4,261,121 A * 4/1981 Coon ..... A47G 25/485 223/96
5,260,914 A * 11/1993 Roberts ..... G09F 11/23 116/308

(Continued)

FOREIGN PATENT DOCUMENTS

CN 203255477 U * 10/2013 ..... B65D 33/16
CN 204473437 U * 7/2015 ..... B65D 33/16

(Continued)

*Primary Examiner* — R. A. Smith
(74) *Attorney, Agent, or Firm* — Lowe Graham Jones PLLC

(57) ABSTRACT

A bag clip comprises a pair of opposing jaws configured for resilient movement between an open position in which the jaws are apart from one another and a closed position in which the jaws are adjacent one another. An indicator wheel attached to the clip includes indicators that may correspond to dates on which the bag was opened and the clip was attached. A second indicator wheel may be included, in which the first wheel may correspond to months of the year and the second wheel may correspond to days of the month.

17 Claims, 6 Drawing Sheets

(56) References Cited

U.S. PATENT DOCUMENTS

| | | | | | |
|---|---|---|---|---|---|
| 5,457,858 | A * | 10/1995 | Lin | A44B 99/00 | 24/501 |
| 7,742,360 | B1 * | 6/2010 | Price | G09F 11/23 | 116/308 |
| 8,453,592 | B2 * | 6/2013 | Edwards et al. | A01K 5/0114 | 116/307 |
| 9,134,288 | B1 * | 9/2015 | Ettinger | G01N 33/04 | |
| 2007/0007303 | A1 * | 1/2007 | Esch | B65D 35/28 | 222/107 |
| 2013/0236608 | A1 * | 9/2013 | Ingram | B65D 33/1616 | 426/87 |

FOREIGN PATENT DOCUMENTS

| | | | | |
|---|---|---|---|---|
| GB | 2479387 | A * | 10/2011 | B65D 51/245 |
| JP | 2004184953 | A * | 7/2004 | G09F 7/10 |

* cited by examiner

BAG CLIP WITH DATE WHEEL

PRIORITY CLAIM

This application claims the benefit of U.S. provisional application Ser. No. 61/935,243 filed Feb. 3, 2014; the contents of which are incorporated by reference.

FIELD OF THE INVENTION

This invention relates generally to clips for binding bags and similar packaging in a closed position.

BACKGROUND OF THE INVENTION

Many food items are sold in a bag which cannot readily be closed with an airtight seal once it is opened. A spring-loaded clip works well to enclose the opened end of the bag by gathering the open portion together and crimping it with the clip. Such a manner of closing is beneficial but generally not air tight. Therefore, once the bag has been opened it is often useful to know how long it has been since the bag was first opened. Presently, neither the clip nor other devices are able to both seal the bag and provide an indication of the date that the bag was first opened.

SUMMARY OF THE INVENTION

A bag clip comprises a pair of opposing jaws configured for resilient movement between an open position in which the jaws are apart from one another to receive a bag or other item to be grasped, and a closed position in which the jaws are adjacent one another to clamp onto the bag or other item and thereby hold it in a closed position. The preferred bag clip with date wheel includes a pair of opposing clip plates resiliently joined to one another such as by a spring that biases the plates toward one another. The plates may be pried apart to create a space for receiving an opening of a bag (or other item to be clipped together), and then the biasing force urges the clip plates closed to likewise close the mouth of the bag.

In one version of the invention, the opposing clip plates are pivotally connected to one another, with a coil spring biasing the plates into a closed position.

A preferred bag clip further includes an indicator wheel which may be in the form of a date indicator, which in one example of the invention is configured as a wheel with a plurality of date-based indicators. A pointer on one of the clip plates points to a particular date on the date wheel, which in one preferred use of the invention will correspond to a date on which the bag was first opened and the clip was first attached.

In some versions of the invention more than one indicator or date wheel may be attached to the clip, for example including a first date indicator for a particular month and a second date indicator for a particular date within the month.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
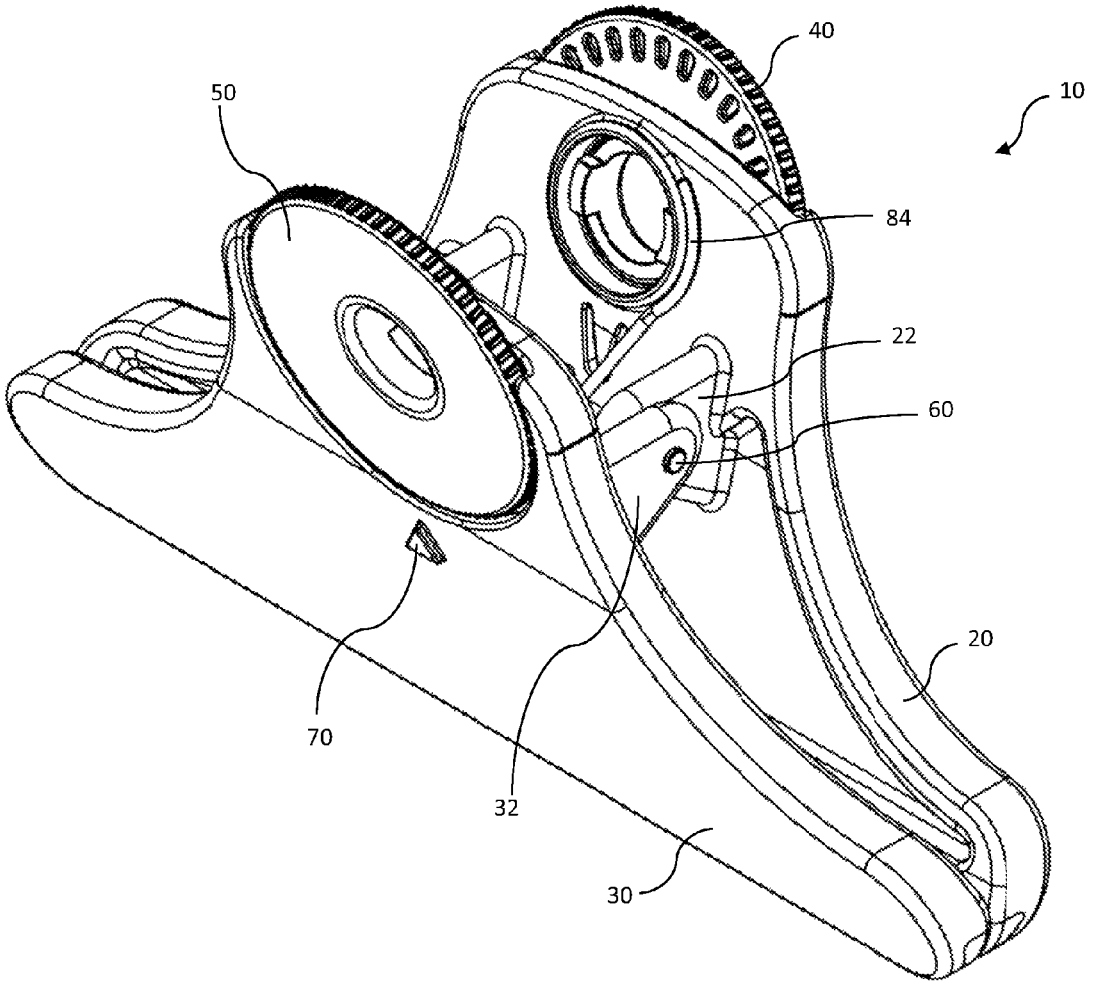
FIG. 1 is a perspective view of a preferred clip with date wheel.

A preferred bag clip 10 is illustrated in the accompanying figures. As illustrated for example in FIG. 1, the clip 10 is in the form of a spring-loaded clip having a pair of opposing jaws which, in the illustrated version are configured as two clip halves joined at a pivot point. In other versions, however, the clip may be in the form of a binder clip which is biased in a closed position by the material properties and formation of the clip, or may use components other than a coil spring to facilitate the pre-stressed closing of the clip.

Most preferably, the clip 10 is formed with a first clip plate 20 and an opposing second clip plate 30. Each of the first and second clip plates in the illustrated version is configured with a wide base or jaw which tapers upward to an upper end configured for grasping by a user. Each of the first and second clip plates 20, 30 further includes an outward facing side 23, 33 and an inward facing side 24, 34 (see FIG. 4). The inward facing side of the first clip plate includes a first pair of standoffs 22, while the inward facing side of the second clip plate includes a second pair of standoffs 32 (see FIG. 5). The inward facing sides of the first and second clip plates are oriented such that they face one another, and therefore each of the pairs of standoffs project from a respective clip plate toward the opposite clip plate.

Although the term clip "plate" is used, it should be understood that neither of the clip plates need be planar or have any particular size such as that of a plate, and that alternate shapes may be used in different versions of the invention.

Figure 4:
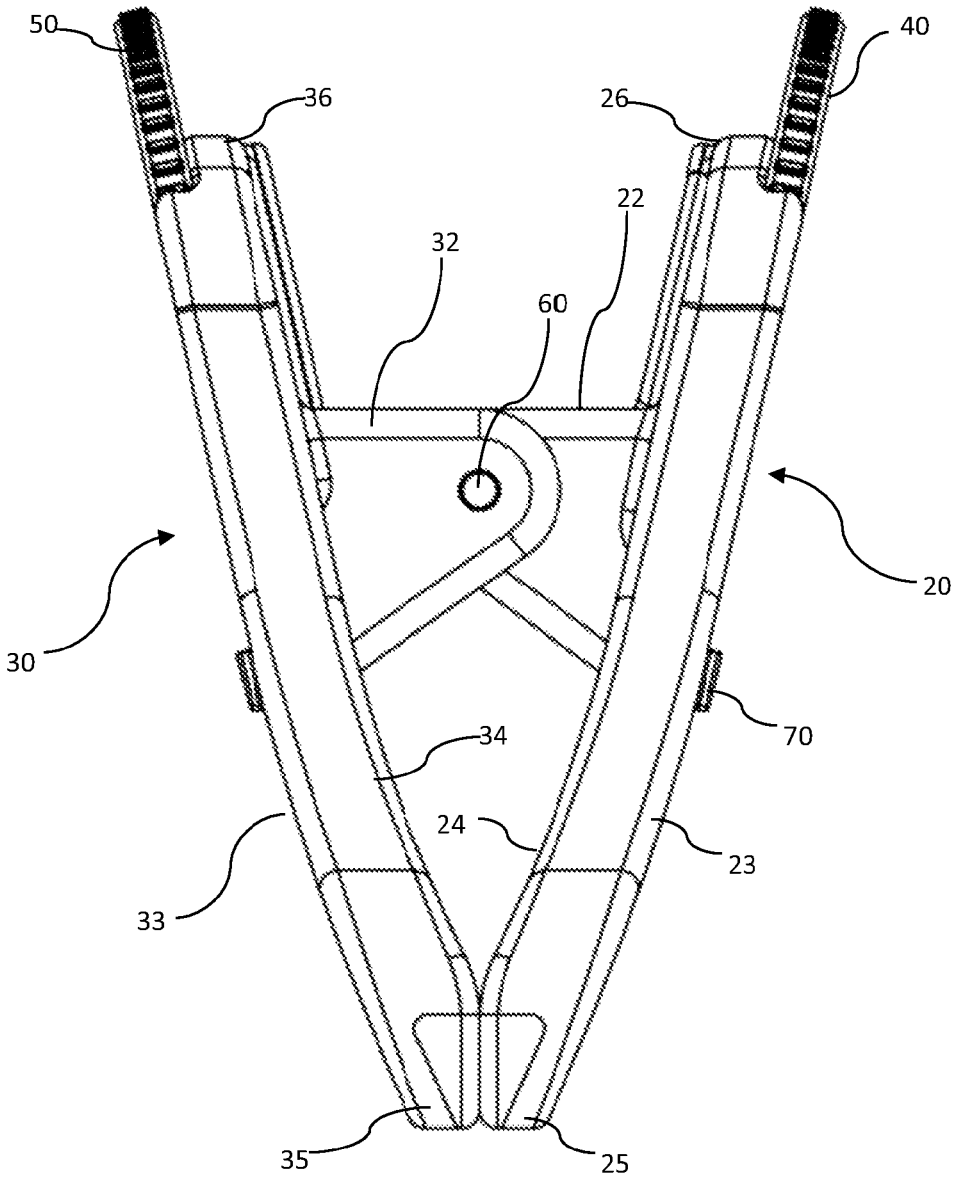
FIG. 4 is a side view of a preferred clip with date wheel.

An axle 60 is positioned to receive holes formed through distal ends of each of the standoffs so that the standoffs, and therefore the clip plates, are attached to the axle for pivotal movement about the axle. As illustrated, and best seen in the side view of FIG. 4, the standoffs are positioned in an intermediate location between the upper ends 26, 36 and the base 25, 35 of the first and second clip plates 20, 30. As discussed below, in the preferred version a spring biases the jaw members in the closed position, which is the position as illustrated in FIG. 4 in which the base 25, 35 of each jaw or clip plate is adjacent or touching one another. The bases of the jaw members may be moved to the open position by applying an inward force to move the upper ends 26, 36 toward one another, which will at the same time move the bases 25, 35 away from one another.

Figure 2:
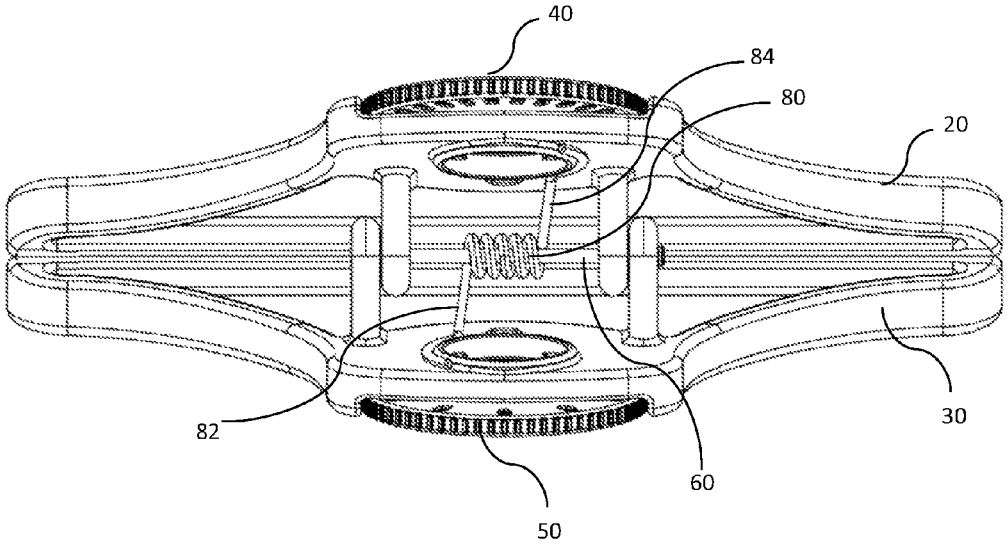
FIG. 2 is a top view of a preferred clip with date wheel.

A spring 80 is attached to the axle or the clip plates in a manner that urges the upper ends of the clip plates apart from one another, and the bases of the clip plates toward one another. In the illustrated version, the coil spring 80 is provided in which the coil spring is carried on the axle 60, with the axle 60 extending through the passageway formed in the center of the coil spring. As best seen in FIG. 2, the coil spring includes a pair of terminal ends 82, 84 with one of the terminal ends 84 being positioned in contact with a first clip plate 20 and the other of the terminal ends 82 being positioned in contact with the second clip plate 30. In each case, the terminal ends of the spring are extended upward, terminating at a location above the axle and therefore in a location between the axle 60 and the top 26, 36 of each clip plate 20, 30. Consequently, the spring is located in a position to urge the upper ends of the clip plates away from one another, and therefore will cause the bottom ends of the clip plates 25, 35 to pivot toward one another.

At least one of the clip plates includes an indicator that is preferably in the form of a date indicator that may be adjusted by a user to indicate a day or date such as the date the bag was first opened or the date the clip was first attached to the bag. In one version, the clip includes a date indicator including labels corresponding to the days of the week, or the days of the month. In some versions, the clip includes a date indicator including the months of the year in addition to the days of the month, and most preferably the date indicator includes multiple date wheels or other settable indicators in such a version.

In accordance with a preferred version, the upper ends of each of the clip plates 20, 30 includes a wheel 40, 50 mounted on the clip plate for rotational movement of the wheel, with the wheel lying in the same plane defined by its respective clip plate. In a preferred version, each wheel is mounted on a respective clip plate such that at least a portion of the wheel extends beyond an outermost edge of the clip plate. Most preferably, a portion of each wheel extends beyond and above the topmost edge of each clip plate.

Figure 5:
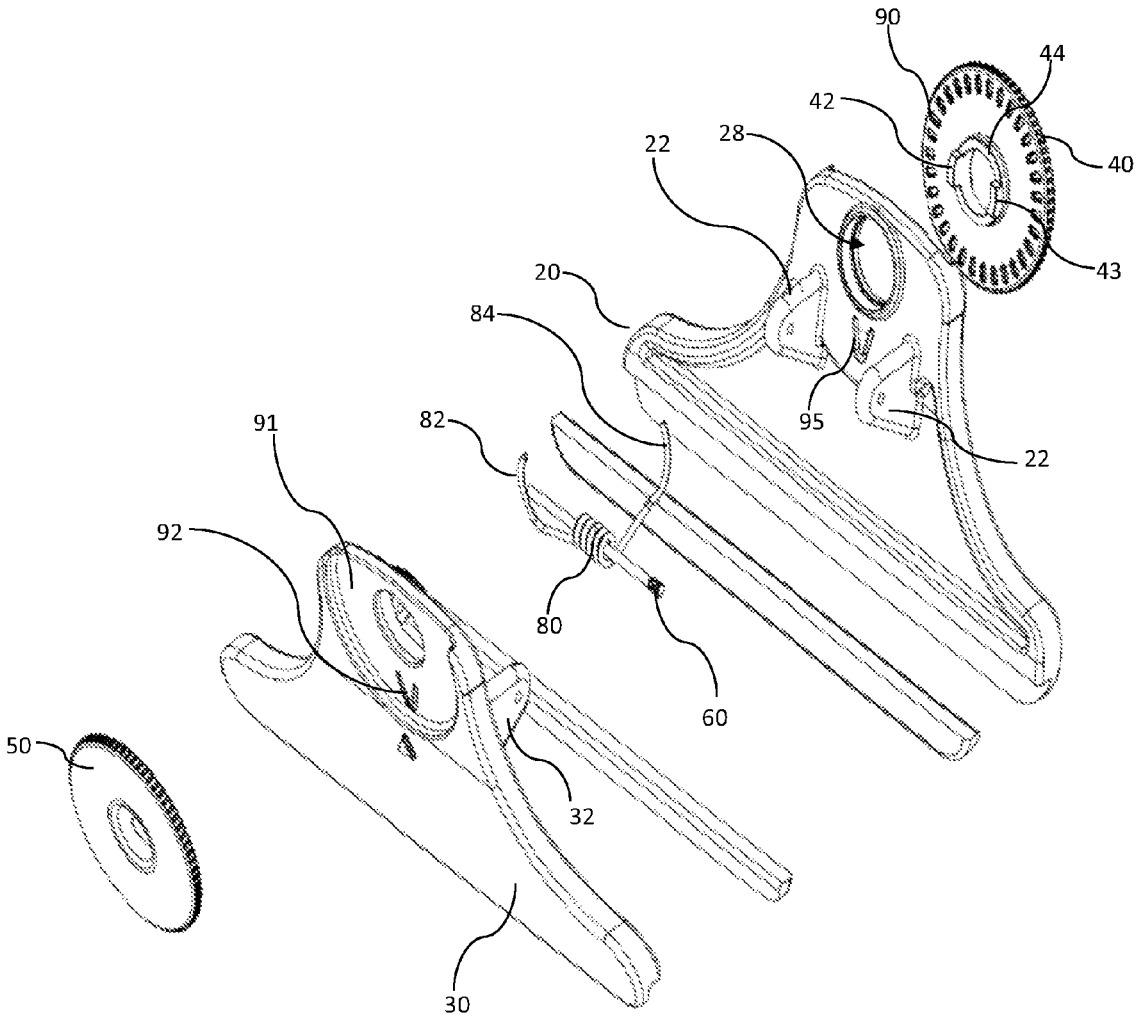
FIG. 5 is an exploded view of a preferred clip with date wheel.
Figure 6:
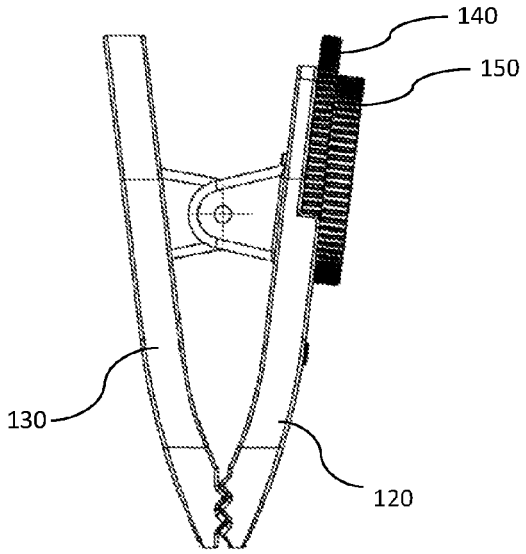
FIG. 6 is a side view of an alternate preferred clip with date wheel.
Figure 7:
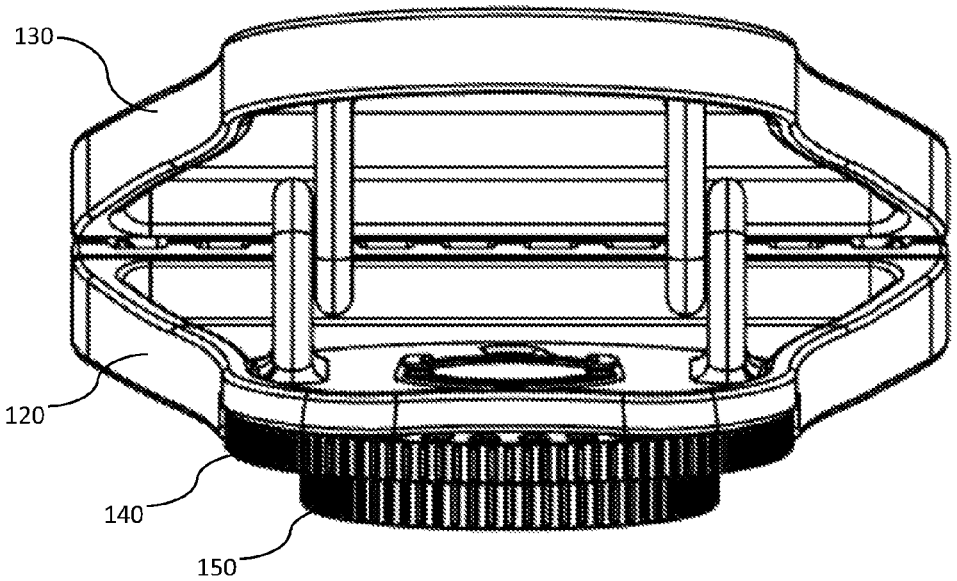
FIG. 7 is a top view of the clip with date wheel of FIG. 6.
Figure 8:
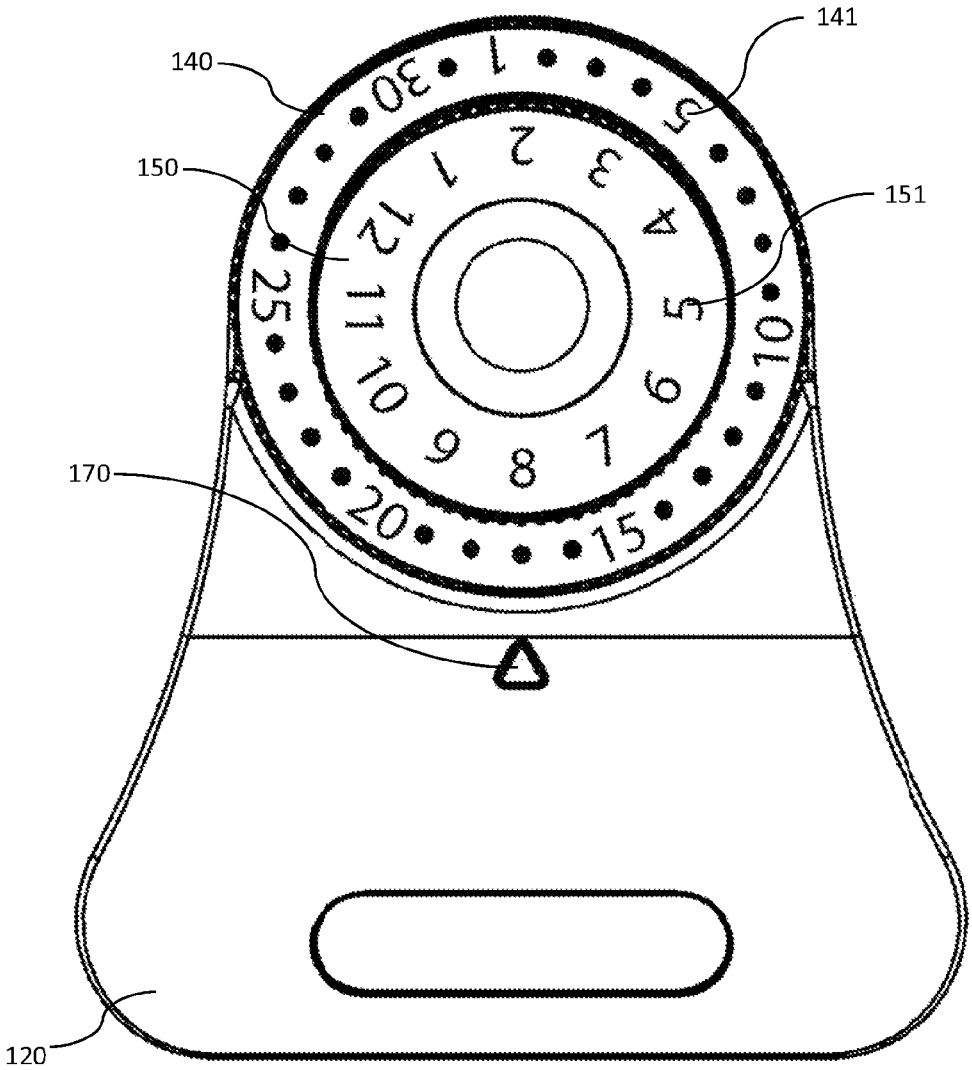
FIG. 8 is a front view of the preferred clip with date wheel of FIG. 6.

As best seen in FIG. 5, each wheel (e.g., 40) is preferably formed with a circular hub 44 terminating in a pair of diametrically opposing feet 42, 43 which extend radially outward from the central hub. The upper portion of the clip plate includes a bore 28 having an interior recessed shelf forming a shoulder for receiving the outwardly extending feet formed on the central hub. With this configuration, each wheel can be snap-fit into a respective bore to retain the wheel for rotational movement within the bore. In one version, each wheel is snugly received by a bore formed in a respective clip plate to prevent rotation of the wheel in the absence of a minimal force applied by a user.

The outer perimeter of each wheel is also preferably formed with outwardly radiating teeth to provide a better grip for rotation by a user. In some versions, the clip plate may include a mating tooth to provide further frictional resistance of the rotation of the wheel, in which the mating tooth extends from a location on the clip plate and into a channel formed between adjacent teeth on the wheel.

In one example of the invention, the upper portion of each clip plate further includes a circular recess (e.g., 91, best seen in FIG. 5) formed in the upper end of each clip plate, which is sized and configured to receive a respective wheel within the recess. In a version in which a portion of the wheel extends beyond the outermost edge of the clip plate, the recess is preferably in the form of a truncated circle in order to receive the portion of the wheel which overlaps with the clip plate. Most preferably, the recess has a depth approximately equal to the thickness of the corresponding wheel so that a top surface of the wheel lies substantially in the same plane as the outer surface of the clip plate.

Figure 3:
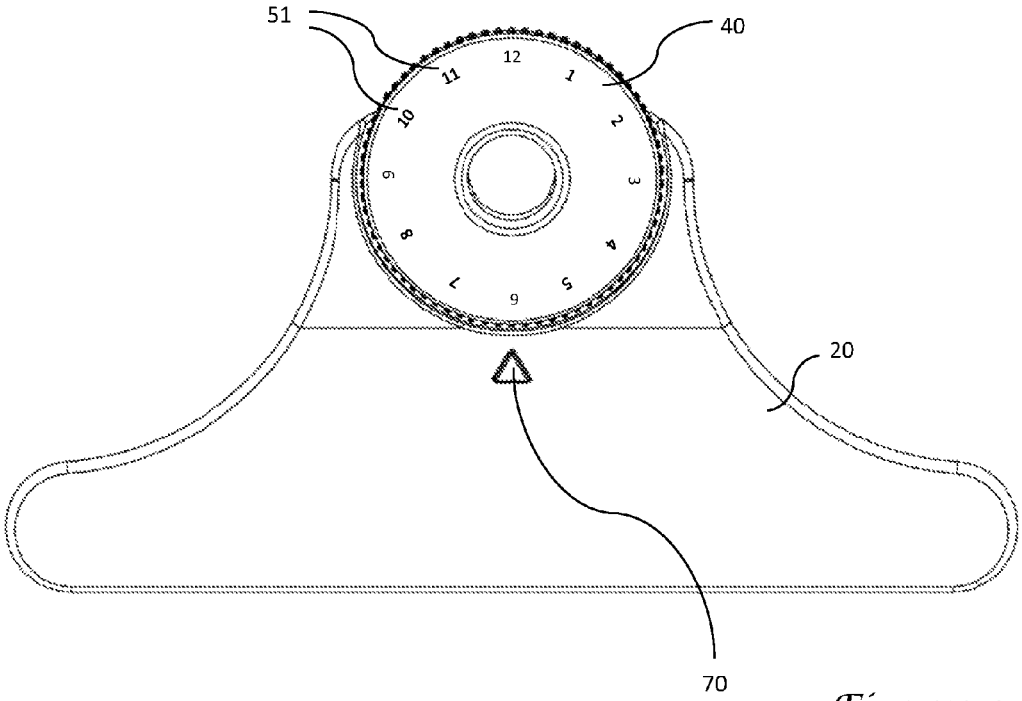
FIG. 3 is a front view of a preferred clip with date wheel.

Each wheel preferably includes a series of indicators 51 (see FIG. 3) positioned about the perimeter of the wheel. In one version of the invention, a first wheel 40 includes the numbers 1 through 12 spaced evenly about the perimeter of the wheel. Beneath the wheel, a pointer 70 is provided to point to a particular indicator on the wheel; thus, in the example illustrated in FIG. 3, the pointer is pointing to the number 6. The pointer may also include a category indicator, such as the word "month" in order to specify that the indicator on the wheel corresponds to a particular month. Although the numbers 1 through 12 are provided in the illustrated version, the wheel may also (or alternatively) include words corresponding to the months of the year.

The second wheel 50 includes numbers provided about the perimeter corresponding to days within a month. Thus, in the illustrated version the second wheel includes 31 separate indicators oriented around the perimeter of the wheel. In some versions each separate indicator may be in the form of a distinct number, while in other versions the indicators may include only a subset of the numbers with dots or other characters provided between the specific numbers. As with the month indicator, the date wheel may also include a category indicator with a category title indicating that the wheel corresponds to a particular date.

In the version of the invention having a date wheel and a month wheel, a user may attach the bag clip to a bag in order to seal the bag, and then rotate the month and date wheels to positions in which the date and month indicators for the appropriate date and month are both adjacent to the pointer on the respective sides of the clip.

Optionally, as shown in FIG. 5, each wheel may be formed with a series of indentations 90 formed on the inward facing side of the wheel, that is, the side opposite of the side having the date or month indicators. Preferably, there are at least as many indentations as indicators on the opposing side, thereby providing a number of discrete stops corresponding to the number of indicators. In addition, the indentations are located in a common circle about the center of the wheel.

Within the recess (e.g., 91) formed in each clip plate, at least one raised projection 92, 95 is formed and positioned to be received within one of the indentations. In a preferred version as illustrated, the raised projection is configured in a downwardly-directed V-shape, with a cutout surrounding the lower portion of the V. In this fashion, the projection is provided on a somewhat flexible V-shaped tongue that is capable of flexing into and out of the indentations 90 as the wheel is turned.

As the wheel is rotated, a certain amount of force is required to cause the indentation to separate from the projection so that the projection may slip into the adjacent indentation. This arrangement thereby prevents the wheel from rotating unless intentionally rotated by a user.

While the wheels are described above as having date and month indicators, in other versions of the invention the wheels may have other indicators corresponding to a plurality of attributes that a user may specify.

In a version of the invention having more than one wheel, at least one wheel may be incorporated into each one of the two clip plates, such as illustrated in FIGS. 1-5. In an alternate version, two wheels may be provided on a single clip plate, such as illustrated in FIGS. 6-9. Thus, in the example of FIGS. 6-9, the clip is formed by a pair of opposing clip plates 120, 130. A pair of indicator wheels such as date wheels 140, 150 are attached to a first one of the clip plates 120.

Most preferably, the pair of date wheels are concentrically attached, with a first one of the date wheels 140 being larger than the second date wheel 150, and each of the first and second date wheels having a center lying in a common axis. In the illustrated example, the first date wheel 140 includes a plurality of indicators 141 extending from 1 to 31, thereby indicating a day of the month corresponding to the indicator most closely adjacent the pointer 170. The second date wheel 150 includes a plurality of indicators 151 extending from 1 to 12, thereby indicating a month of the year. As with the version described above, the wheels may include words (such as the names of the months) or other indicators other than numbers.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A bag clip, comprising:

a first clip plate having a first upper end and a first lower jaw;

a second clip plate having a second upper end and a second lower jaw;

the first lower jaw and the second lower jaw forming a pair of opposing jaws configured for resilient movement between an open position in which the jaws are apart from one another and a closed position in which the jaws are adjacent one another, the pair of opposing jaws being biased toward the closed position;

further wherein the first upper end and the second upper end are configured for movement toward one another to cause the pair of jaws to move to the open position, and to be positioned apart from one another when the jaws are in the closed position; and a first date wheel mounted on the first upper end of the first clip plate for movement toward the second upper end together with the first upper end, the first date wheel being rotatable to a plurality of positions corresponding to a plurality of dates.

2. The bag clip of claim 1, wherein the first clip plate comprises a first standoff and the second clip plate comprises a second standoff, the first standoff being pivotally attached to the second standoff for pivotal movement of the first clip plate with respect to the second clip plate.

3. The bag clip of claim 2, further comprising an axle supported by at least one of the first standoff or the second standoff, the axle carrying a coil spring having a first end in contact with the first clip plate and a second end in contact with the second clip plate to bias the first clip plate and the second clip plate toward the closed position.

4. The bag clip of claim 2, further comprising a spring in contact with the first clip plate and the second clip plate, the spring being positioned to bias the first clip plate and the second clip plate toward the closed position.

5. The bag clip of claim 4, wherein the first date wheel further comprises a first plurality of indicators.

6. The bag clip of claim 5, further comprising a pointer on the first clip plate, each of the first plurality of indicators being associated with a corresponding one of the plurality of positions, the pointer being positioned to point to an adjacent one of the first plurality of indicators when the date wheel is rotated to the corresponding one of the plurality of positions.

7. The bag clip of claim 5, further comprising a second date wheel mounted on the clip, the second date wheel having a second plurality of indicators.

8. The bag clip of claim 7, wherein the first plurality of indicators represent a plurality of months of the year and the second plurality of indicators represent a plurality of days of the month.

9. The bag clip of claim 8, wherein the second date wheel is mounted on the second clip plate.

10. The bag clip of claim 9, wherein:

the first date wheel being positioned on the first clip plate wherein a portion of the first date wheel is overlying the first clip plate and a portion of the first date wheel extends laterally beyond the first upper end of the first clip plate;

the second date wheel being positioned on the second clip plate wherein a portion of the second date wheel is overlying the second clip plate and a portion of the second date wheel extends laterally beyond the second upper end of the second clip plate.

11. The bag clip of claim 8, wherein the second date wheel is mounted on the first clip plate.

12. A bag clip, comprising:

a first clip plate;

a second clip plate joined to the first clip plate to form a pair of opposing jaws configured for resilient movement between an open position in which the jaws are apart from one another and a closed position in which the jaws are adjacent one another, the pair of opposing jaws being biased toward the closed position; and a first indicator wheel mounted on the first clip plate and extending beyond an outermost edge of the first clip plate, the first indicator wheel being moveable with the first clip plate toward the second clip plate to cause the pair of opposing jaws to move to the open position, the first indicator wheel having a plurality of indicators on the first indicator wheel and being rotatable to a plurality of positions corresponding to the plurality of indicators.

13. The bag clip of claim 12, wherein the first indicator wheel comprises an inner face facing toward the first clip plate and an opposing outer face facing away from the first clip plate, the plurality of indicators being positioned on the outer face, the inner face further comprising a plurality of indentations which interact with a projection positioned on the first clip plate to hinder rotation of the first indicator wheel.

14. The bag clip of claim 12, further comprising a second indicator wheel mounted on the second clip plate, the second indicator wheel having a second plurality of indicators.

15. The bag clip of claim 14, wherein the first plurality of indicators represent a plurality of months of the year and the second plurality of indicators represent a plurality of days of the month.

16. The bag clip of claim 12, further comprising a second indicator wheel mounted on the first clip plate, the second indicator wheel having a second plurality of indicators.

17. The bag clip of claim 12, wherein the first clip plate is pivotally attached to the second clip plate at a pivot location, a spring being attached to the bag clip and positioned to bias the first clip plate and the second clip plate toward the closed position.

* * * * *